US010836172B2

(12) United States Patent
Inui et al.

(10) Patent No.: US 10,836,172 B2
(45) Date of Patent: Nov. 17, 2020

(54) RECORDING HEAD AND INK-JET RECORDING APPARATUS THEREWITH

(71) Applicant: KYOCERA Document Solutions Inc., Osaka (JP)

(72) Inventors: Yasutaka Inui, Osaka (JP); Kenichi Satake, Osaka (JP); Takuma Araki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/349,927

(22) PCT Filed: Oct. 2, 2017

(86) PCT No.: PCT/JP2017/035772

§ 371 (c)(1),
(2) Date: May 14, 2019

(87) PCT Pub. No.: WO2018/131226

PCT Pub. Date: Jul. 19, 2018

(65) Prior Publication Data

US 2019/0329556 A1 Oct. 31, 2019

(30) Foreign Application Priority Data

Jan. 13, 2017 (JP) ..... 2017-003925

(51) Int. Cl.
*B41J 2/165* (2006.01)

(52) U.S. Cl.
CPC ..... *B41J 2/16538* (2013.01)

(58) Field of Classification Search
CPC B41J 2/16552; B41J 2/16585; B41J 2/16538; B41J 2/16535; B41J 2/16517; B41J 2/165
See application file for complete search history.

(56) References Cited

U.S. PATENT DOCUMENTS

| | | | | |
|---|---|---|---|---|
| 6,283,575 | B1 | 9/2001 | Hawkins et al. | 347/28 |
| 2009/0304990 | A1 | 12/2009 | Kobayashi | 428/137 |

FOREIGN PATENT DOCUMENTS

| | | | |
|---|---|---|---|
| JP | 4-176657 | A | 6/1992 |
| JP | 2000-326517 | A | 11/2000 |
| JP | 2007-83496 | A | 4/2007 |
| JP | 2009-292104 | A | 12/2009 |
| JP | 2013-049246 | A | 3/2013 |

*Primary Examiner* — Jannelle M Lebron
(74) *Attorney, Agent, or Firm* — Stein IP, LLP

(57) ABSTRACT

Provided are a recording head and an ink jet recording apparatus provided with the same capable of cleaning an ink ejection surface while preventing damage to a wiper. The recording head is provided with an ink ejection surface including an ink ejection region in which a plurality of ink ejection ports for ejecting ink onto a sheet is opened. With respect to the ink ejection region, on the upstream side in a wiping direction in which a wiper wipes the ink ejection surface, a plurality of concave parts is provided. Inside each of the concave parts, two or more cleaning liquid supply ports for supplying a cleaning liquid are provided in the wiping direction.

7 Claims, 9 Drawing Sheets

RECORDING HEAD AND INK-JET RECORDING APPARATUS THEREWITH

CROSS-REFERENCE TO RELATED APPLICATIONS

This is a national stage application which claims the benefit of priority to International Application No. PCT/JP2017/035772 filed Oct. 2, 2017, which claims the benefit of priority to Japanese Application No. 2017-003925, filed Jan. 13, 2017, in the Japanese Patent Office, the disclosures of which are incorporated in their entireties by reference.

TECHNICAL FIELD

The present invention relates to a recording head including ink ejection openings for ejecting ink onto a recoding medium such as a sheet, and also relates to an ink-jet recording apparatus provided with such a recording head.

BACKGROUND ART

As recording apparatuses such as facsimile machines, copiers, and printers, ink-jet recording apparatuses, which form images by ejecting ink, are widely used for their ability to form high-definition images.

In such ink-jet recording apparatuses, fine ink droplets (hereinafter, referred to as mist) which are ejected together with ink droplets for image recording, and splashed mist which is generated when ink droplets attach to the recording medium, attach to and solidify on an ink ejection face of a recording head. As mist on the ink ejection face gradually increases and covers the ink ejection openings, it causes, for example, degraded straightness of the ink trajectory (curved flight) or ejection failure, and leads to degraded printing performance of the recording head.

There are also known ink-jet recording apparatuses provided with, for cleaning the ink ejection face of the recording head, a plurality of cleaning liquid supplying openings in a part of the ink ejection face outside an ink ejection region (upstream in the direction of wiping by a wiper) in which a plurality of ink ejection openings are open. In such ink-jet recording apparatuses, after the cleaning liquid is supplied from the cleaning liquid supplying openings, the wiper can be moved across the ink ejection face starting outward of the cleaning liquid supplying openings so that the wiper wipes the ink ejection face while holding the cleaning liquid. Recovery operation for the recording head is thus performed.

An ink-jet recording apparatus provided with a plurality of cleaning liquid supplying openings in the ink ejection face of the recording head is disclosed, for example, in Patent Documents 1 identified below.

LIST OF CITATIONS

Patent Literature

Patent Document 1: JP-A-2007-83496

Non-Patent Literature

SUMMARY OF THE INVENTION

Problem to be Solved by the Invention

However, in the conventional ink-jet recording apparatus mentioned above, the wiper passes over the cleaning liquid supplying openings every time recovery processing for the recording head is performed, and thus, inconveniently, the tip end of the wiper is damaged by the edge of the cleaning liquid supplying openings. If the tip end of the wiper is damaged so severely as to be chipped away, the wiping performance of the wiper is significantly degraded to leave unwiped areas.

The present invention has been made to solve the above problem. An object of the present invention is to provide a recording head which can clean an ink ejection face while preventing a wiper from being damaged and to provide an inkjet recording apparatus provided with such a recording head.

Means for Solving the Problem

A recording head according to a first aspect of the present invention is provided with an ink ejection face which includes an ink ejection region in which a plurality of ink ejection openings for ejecting ink onto a recording medium are open. Upstream of the ink ejection region in the wiping direction which is the direction in which a wiper wipes the ink ejection face, a plurality of depressed portions are provided. Inside each depressed portion, two or more cleaning liquid supplying openings for supplying cleaning liquid are provided along the wiping direction.

Advantageous Effects of the Invention

With a recording head according to the first aspect of the present invention, upstream of an ink ejection region in the wiping direction, a plurality of depressed portions are provided. Inside each depressed portion, cleaning liquid supplying openings for supplying cleaning liquid are provided. With this, after the cleaning liquid is supplied from the cleaning liquid supplying openings, a wiper can be moved across an ink ejection face starting upstream of the depressed portion in the wiping direction so that the wiper wipes the ink ejection face while holding the cleaning liquid. Thus, the ink ejection face can be cleaned.

Inside each depressed portion, two or more cleaning liquid supplying openings are provided along the wiping direction. With this, when recovery operation for the recording head is performed, the number of times the wiper passes the edge of the depressed portion is smaller than the number of times the wiper passes the edge of the cleaning liquid supplying openings. That is, the number of times the tip end of the wiper is rubbed against the edge can be reduced. This helps prevent the tip end of the wiper from being damaged.

This and other objects of the present invention, and the specific benefits obtained according to the present invention, will become apparent from the description of embodiments which follows.

DESCRIPTION OF EMBODIMENTS

Now, embodiments of the present invention are described with reference to the drawings.

Figure 1:
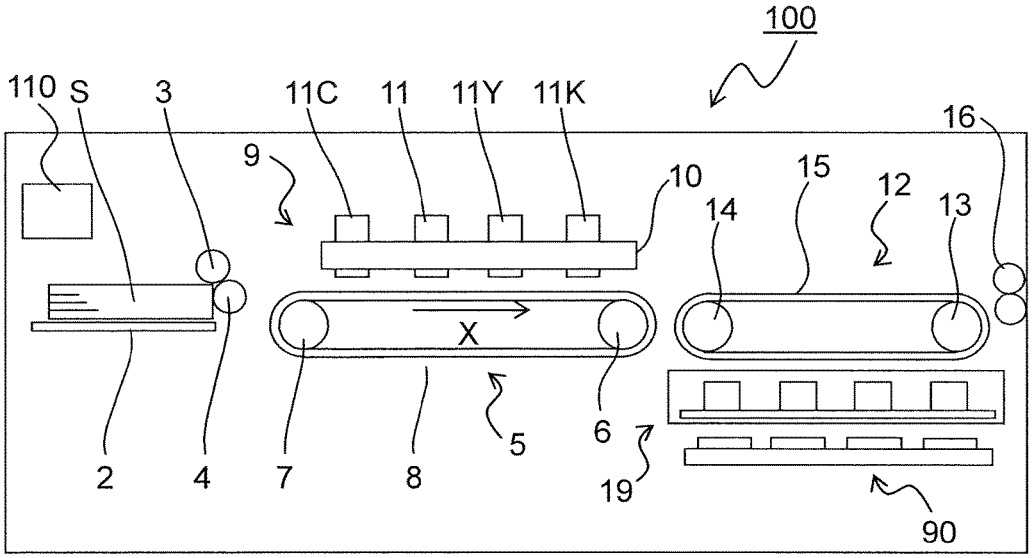
FIG. 1 A diagram showing the structure of an ink-jet recording apparatus provided with a recording head according to one embodiment of the present invention.

As shown in FIG. 1, in an ink-jet recording apparatus 100 according to one embodiment of the present invention, in a left-side part, a sheet feeding tray 2 which houses sheets S (a recording medium) is provided. At one end part of the sheet feeding tray 2, there are provided a sheet feeding roller 3 that coveys and feeds the housed sheets S one after another, starting with the top sheet S, to a first conveying unit 5, which will be described later, and a driven roller 4 that is in pressed contact with the sheet feeding roller 3 to rotate by following it.

On the downstream side (right side in FIG. 1), in the sheet conveying direction (arrow X direction), of the sheet feeding roller 3 and the driven roller 4, the first conveying unit 5 and a recording portion 9 are arranged. The first conveying unit 5 is configured to include a first driving roller 6, a first driven roller 7, and a first conveying belt 8 which is stretched between the first driving roller 6 and the first driven roller 7. According to a control signal from a control portion 110 of the ink-jet recording apparatus 100, the first driving roller 6 is driven to rotate in the clockwise direction and thus a sheet S held on the first conveying belt 8 is conveyed in the arrow X direction.

Figure 2:
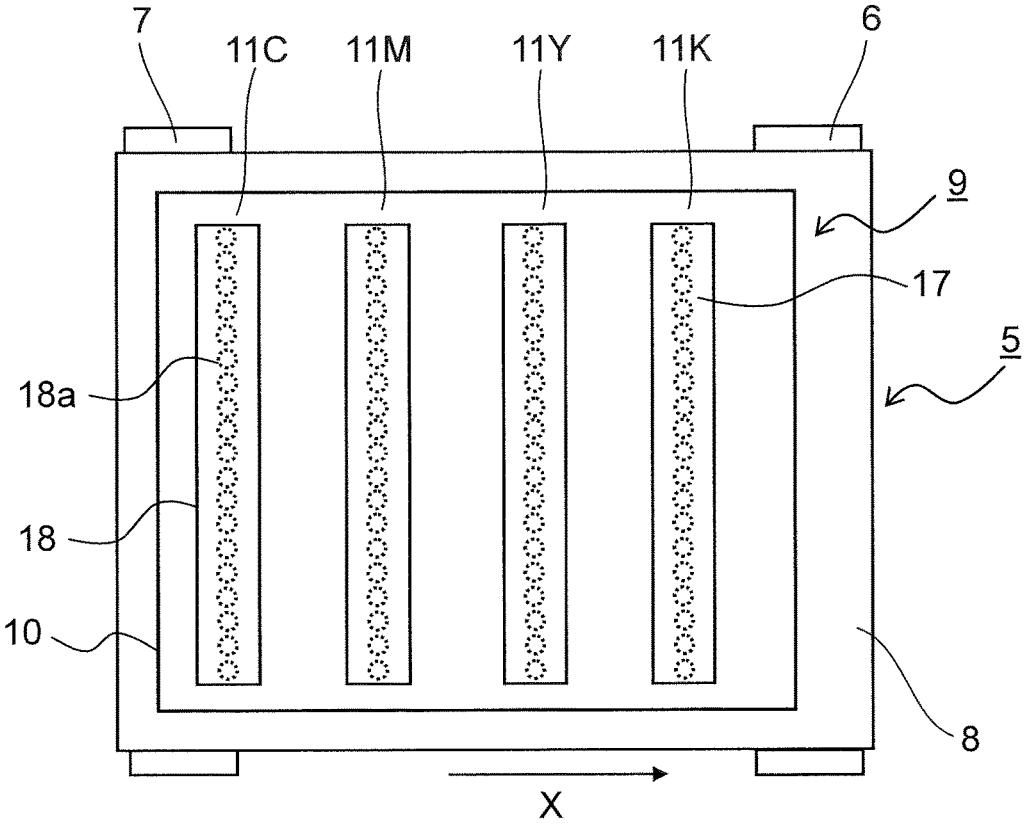
FIG. 2 A diagram showing a first conveying unit and a recording portion of the ink-jet recording apparatus shown in FIG. 1 as seen from above.

The recording portion 9 includes a head housing 10 and line heads 11C, 11M, 11Y and 11K which are held on the head housing 10. These line heads 11C to 11K are supported at such a height that a predetermined gap (for example, 1 mm) is formed relative to the conveying face of the first conveying belt 8. As shown in FIG. 2, the line heads 11C to 11K include one or more (here, one) recording heads 17 which extend in the sheet width direction (up-down direction in FIG. 2) perpendicular to the sheet conveying direction.

Figure 3:
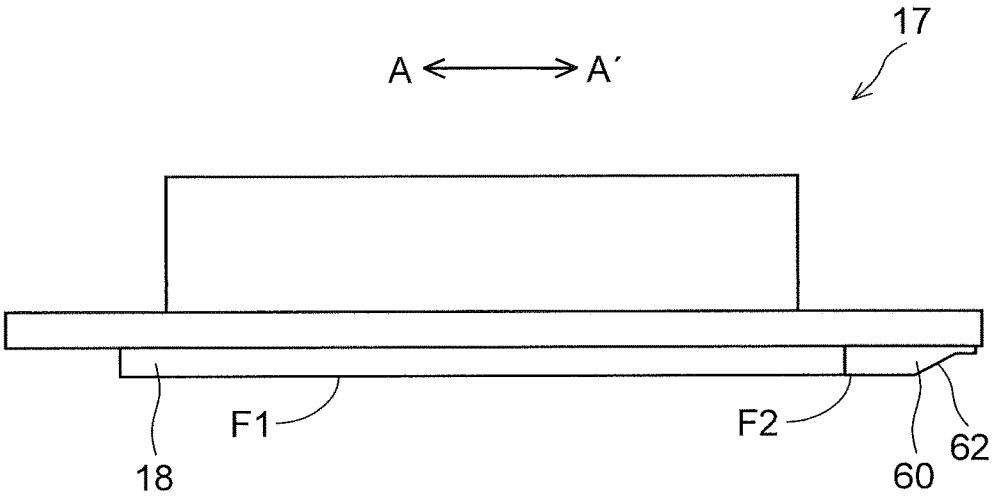
FIG. 3 A diagram showing the recording head which constitutes line heads in the recording portion.
Figure 4:
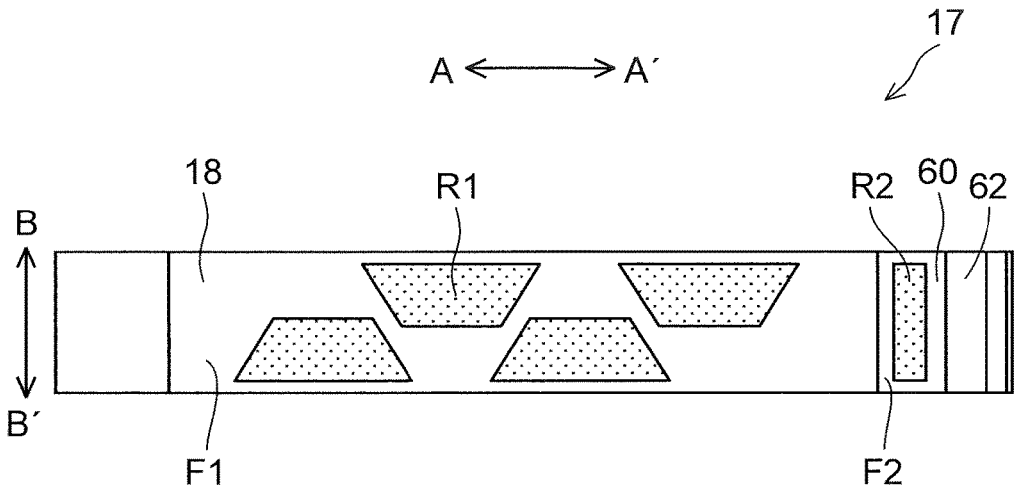
FIG. 4 A diagram showing the recording head as seen from the ink ejection face side.

As shown in FIGS. 3 and 4, at an ink ejection face F1 on a head portion 18 of the recording head 17, there is provided an ink ejection region R1 in which a number of ink ejection openings 18*a* (see FIG. 2) are arrayed.

To the recording head 17 constituting the line heads 11C to 11K, ink of four colors (cyan, magenta, yellow, and black) stored in ink tanks (unillustrated) is supplied, ink of the different colors being supplied to corresponding ones of the line heads 11C to 11K respectively.

According to the control signal from the control portion 110 (see FIG. 1), and based on image data received from an external computer, the recording head 17 ejects ink from the ink ejection openings 18*a* toward the sheet S which is conveyed while being held by absorption on the conveying face of the first conveying belt 8. With this, on the sheet S on the first conveying belt 8, there is formed a color image having ink of four colors, namely cyan, magenta, yellow and black, overlaid together.

On the recording head 17, a cleaning liquid supplying member 60 for supplying a cleaning liquid is provided. The cleaning liquid supplying member 60 is arranged adjacent to the head portion 18, on its upstream side (right side in FIG. 3) in the wiping direction of a wiper 35, which will be described later. The cleaning liquid supplying member 60 has a cleaning liquid supplying face F2 which include a cleaning liquid supplying region R2 on which a number of cleaning liquid supplying openings 60*a* (see FIG. 5) for supplying the cleaning liquid are arrayed. On the head portion 18, at least the ink ejection face F1 is formed of, for example, SUS (stainless steel). On the cleaning liquid supplying member 60, at least the cleaning liquid supplying face F2 is formed of, for example, SUS or resin.

The cleaning liquid supplying face F2 is formed so as to be flush with the ink ejection face F1. In a part of the cleaning liquid supplying member 60 upstream (right-side in FIG. 3) of the cleaning liquid supplying face F2 in the wiping direction, an inclined face 62 is formed.

Figure 5:
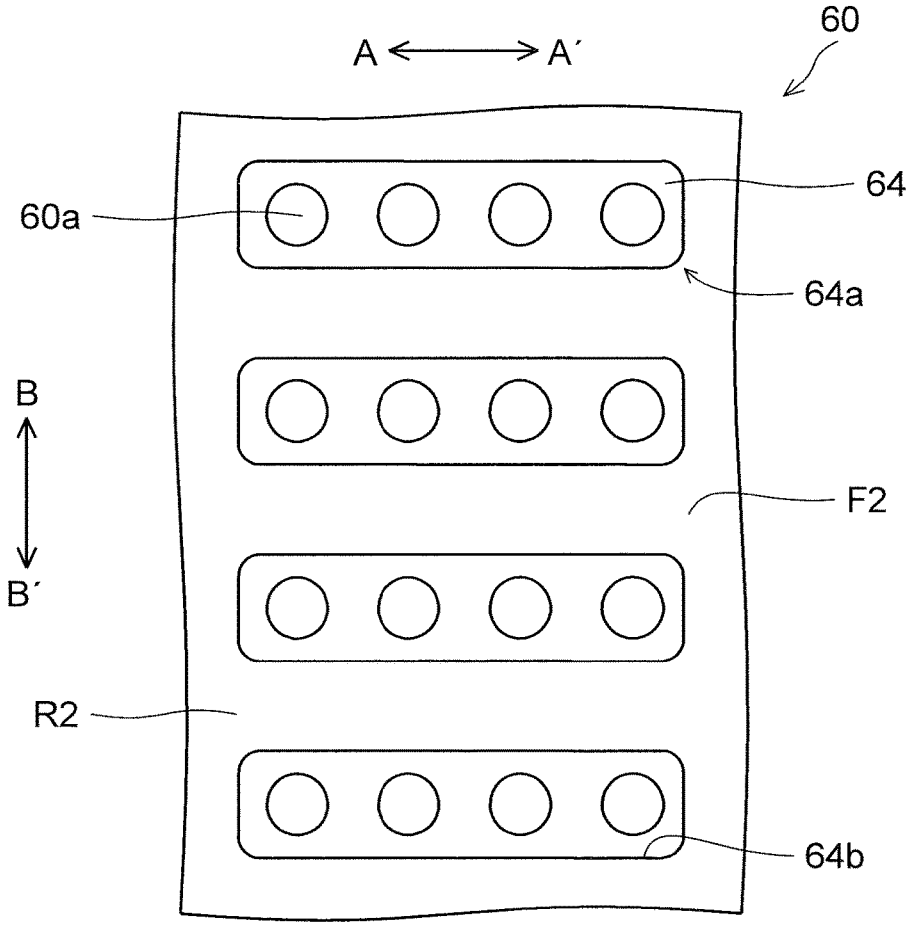
FIG. 5 A diagram showing a depressed portion and cleaning liquid supplying openings in a cleaning liquid supplying member on the recording head as seen from below.
Figure 6:
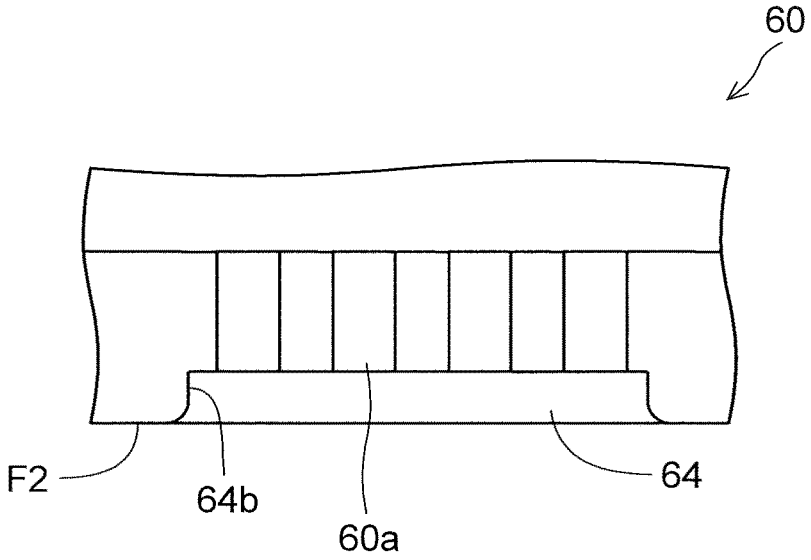
FIG. 6 A diagram showing the structure of the depressed portion and the cleaning liquid supplying openings in the cleaning liquid supplying member on the recording head.

Here, in the cleaning liquid supplying region R2 of the cleaning liquid supplying member 60, as shown in FIGS. 5 and 6, a plurality of depressed portions 64 are arranged in the head width direction (arrow BB' direction, the direction perpendicular to the wiping direction) at a predetermined interval. FIG. 5 only shows one row of a plurality of depressed portions 64 which are arranged along the head width direction, but a plurality of such rows may be provided adjacent to each other in the wiping direction (arrow A direction).

Inside the depressed portion 64, a plurality of (here, four) cleaning liquid supplying openings 60*a* for supplying a cleaning liquid are provided. The cleaning liquid supplying openings 60*a* are connected to the top face of the depressed portion 64.

Figure 7:
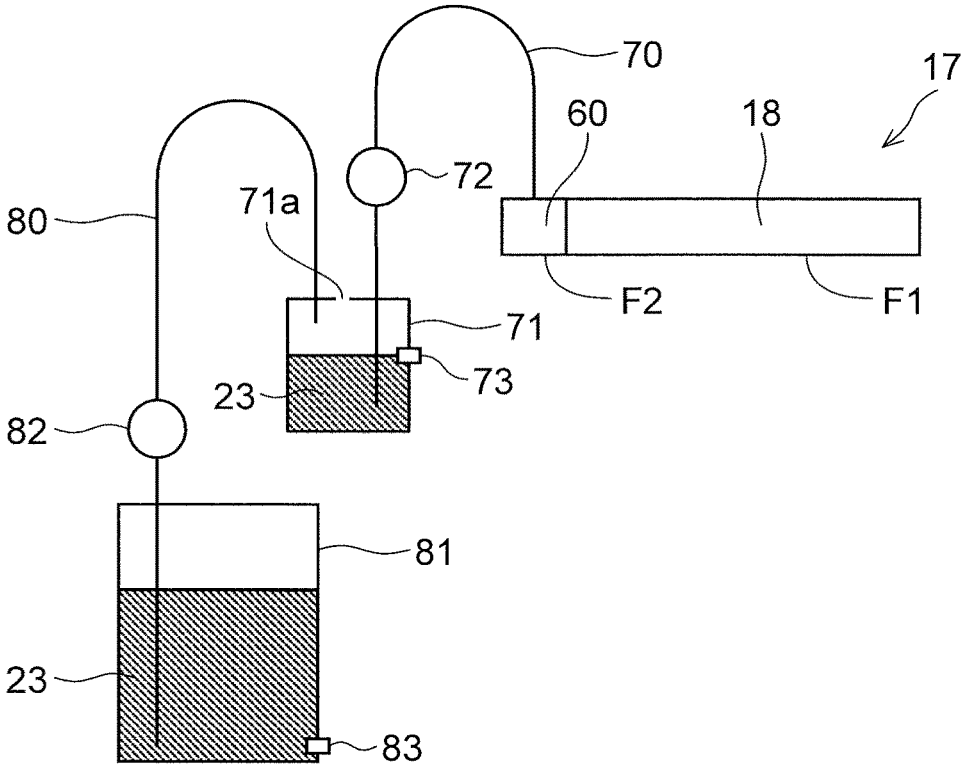
FIG. 7 A diagram showing the structure of and around the recording head, a tank, and a replenishing tank.

As shown in FIG. 7, the cleaning liquid supplying openings 60*a* (see FIG. 5) in the cleaning liquid supplying member 60 are connected to a downstream end of a cleaning liquid supplying path 70 which comprises a tube through which cleaning liquid 23 passes. An upstream end of the cleaning liquid supplying path 70 is connected to a subtank (tank) 71 in which is stored the cleaning liquid 23 for supply to the cleaning liquid supplying member 60. The upstream end of the cleaning liquid supplying path 70 is immersed in the cleaning liquid 23. The cleaning liquid supplying path 70 is provided with a supplying pump 72 that pumps up the cleaning liquid 23 from the subtank 71 to feed it to the cleaning liquid supplying member 60. In the diagram, the cleaning liquid 23 is indicated by hatching to facilitate understanding.

The subtank 71 is connected to a downstream end of a cleaning liquid replenishing path 80 comprising a tube through which the cleaning liquid 23 passes. An upstream end of the cleaning liquid replenishing path 80 is connected to a replenishment tank (also called a main tank) 81 in which is stored the cleaning liquid 23 for supply to the subtank 71. The upstream end of the cleaning liquid replenishing path 80 is immersed in the cleaning liquid 23. The cleaning liquid replenishing path 80 is provided with a replenishing pump 82 that pumps up the cleaning liquid 23 from the main tank 81 to feed it to the subtank 71. For the supplying pump 72 and the replenishing pump 82, for example, a tube pump, a syringe pump, or a diaphragm pump can be used. The supplying pump 72 is so configured that it can switch, when the supply is stopped, between a state where the path between an inflow port and an outflow port of the supplying pump 72 is blocked and a state where those ports communicate with each other. The detailed structure of and around the cleaning liquid supplying member 60, the subtank 71 and the main tank 81 will be described later.

In this ink-jet recording apparatus 100, to clean the ink ejection face F1 on the recording head 17, at the start of printing after a long out-of-operation period and during intermissions of printing operation, ink is discharged forcibly from the ink ejection openings 18*a* in all the recording heads 17. Then the cleaning liquid 23 is supplied through the cleaning liquid supplying openings 60*a* (see FIG. 5) in all the recording heads 17 to the cleaning liquid supplying region R2, and the ink ejection face F1 is wiped with the wiper 35, which will be described later, in preparation for the next printing operation.

As shown back in FIG. 1, on a downstream side (right side in FIG. 1) of the first conveying unit 5 in the sheet conveying direction, a second conveying unit 12 is arranged. The second conveying unit 12 is configured to include a second driving roller 13, a second driven roller 14, and a second conveying belt 15 which is stretched between the second driving roller 13 and the second driven roller 14. The second driving roller 13 is driven to rotate in the clockwise direction and thus a sheet S held on the second conveying belt 15 is conveyed in the arrow X direction.

The sheet S with an ink image recorded on it at the recording portion 9 is conveyed to the second conveying unit 12. While the sheet S passes through the second conveying unit 12, the ink ejected on the surface of the sheet S is dried. Under the second conveying unit 12, a maintenance unit 19 and a cap unit 90 are arranged. When wiping operation is performed by the wiper 35 as mentioned above, the first conveying unit 5 descends. Then the maintenance unit 19 moves to under the recording portion 9, wipes off the ink discharged forcibly from the ink ejection openings 18*a* in the recording head 17 and the cleaning liquid 23 supplied from the cleaning liquid supplying openings 60*a*, and collects the ink and the cleaning liquid 23 wiped off. When capping the ink ejection face F1 (see FIG. 3) on the recording head 17, the first conveying unit 5 descends. Then the cap unit 90 horizontally moves to under the recording portion 9, and then moves upward to be fitted to the lower face of the recording head 17.

On the downstream side of the second conveying unit 12 in the sheet conveying direction, there is provided a discharge roller pair 16 which discharges the sheet S with an image recorded on it to outside the apparatus main body. On the downstream side of the discharge roller pair 16, there is provided a discharge tray (unillustrated) on which the sheets S discharged outside the apparatus main body is stacked.

The maintenance unit 19 includes a plurality of wipers 35 (see FIG. 10) which are movable along the ink ejection face F1, a substantially rectangular carriage (unillustrated) on which the plurality of wipers 35 are fixed, and a supporting frame (unillustrated) which supports the carriage. The carriage (unillustrated) is supported so as to be slidable in the arrow AA' direction relative to the supporting frame (unillustrated).

The wiper 35 is an elastic member (for example, a rubber member made of EPDM) for wiping the cleaning liquid 23 supplied from the cleaning liquid supplying openings 60*a* (see FIG. 5) in each recording head 17. The wiper 35 is kept in pressed contact with a part (here, the inclined face 62) of the cleaning liquid supplying member 60 upstream of the cleaning liquid supplying region R2 (see FIG. 4) in the wiping direction. As the carriage (unillustrated) moves, the wiper 35 wipes the cleaning liquid supplying face F2 and the ink ejection face F1 in the predetermined direction (arrow A direction).

Next, the structures of and around the cleaning liquid supplying member 60, the subtank 71 and the main tank 81 will be described in detail.

As shown in FIG. 7, at a predetermined position in the subtank 71, a first detection sensor 73 for sensing the cleaning liquid 23 is provided. The first detection sensor 73 has an electrode pair (unillustrated) to which a voltage is applied and which is arranged inside the subtank 71. The first detection sensor 73 can, based on whether a current is present between the electrodes, sense the presence or the absence of the cleaning liquid 23. When the first detection sensor 73 senses the absence of the liquid (absence of the current), the cleaning liquid 23 is supplied by the replenishing pump 82 from the main tank 81 to the subtank 71 until the presence of the liquid (presence of the current) is sensed. With this, the liquid level (top face) of the cleaning liquid 23 inside the subtank 71 is substantially kept constant.

In a lower part of the main tank 81, a second detection sensor 83 for sensing the cleaning liquid 23 is provided. The second detection sensor 83 has an electrode pair (unillustrated) to which a voltage is applied and which is arranged inside the main tank 81. The second detection sensor 83 can, based on whether a current is present between the electrodes, sense the presence or the absence of the cleaning liquid 23. When the second detection sensor 83 senses the absence of the liquid, and a display panel (unillustrated) of the ink-jet recording apparatus 100 indicates that the main tank 81 has become empty. With this, a user or an operator replaces the main tank 81 with a new one, or replenishes the main tank 81 with the cleaning liquid 23.

The subtank 71 is arranged above the main tank 81 and below the cleaning liquid supplying face F2 of the recording head 17. The subtank 71 is provided with an atmospheric open port 71*a* for equalizing the pressure in its internal space with the atmospheric pressure. Thus, in a state where the supplying pump 72 is off, if the path between the inflow port and the outflow port of the supplying pump 72 is switched to a communicating state, a negative pressure is applied to the cleaning liquid 23 in the cleaning liquid supplying openings 60*a*.

As shown in FIG. 5, the depressed portion 64 is formed in a substantially rectangular shape as seen in a plan view (as seen from bottom in FIG. 6) so as to extend along the wiping direction. The length of the depressed portion 64 in the wiping direction is, for example, equal to or longer than a few millimeters, and its length in the head width direction (arrow BB' direction) is, for example, equal to or shorter than 1 mm. Inside each depressed portion 64, two or more (here, four) cleaning liquid supplying openings 60*a* are provided along the wiping direction.

Four corner portions 64*a* of the outer edge of the depressed portion 64 are rounded as seen in a plan view. The size of the rounding (the radius) is, for example, 0.5 mm or larger but 1 mm or smaller.

Of the outer edge of the depressed portion 64, as shown in FIG. 6, a part which intersects with the cleaning liquid supplying face F2 (the face wiped by the wiper 35) is rounded as seen in a cross-sectional view. In other words, a part where the inner face 64*b* of the depressed portion 64 and the cleaning liquid supplying face F2 intersect is rounded as seen in a cross-sectional view. This rounding is formed around the entire outer edge of the depressed portion 64. The size of the rounding (the radius) is, for example, 0.5 mm.

Next, recovery operation for the recording head 17 using the maintenance unit 19 in the ink-jet recording apparatus 100 of this embodiment will be described. Recovery operation for the recording head 17 described below is performed by controlling the operation of the recording head 17, the maintenance unit 19, the supplying pump 72, and the like based on the control signal from the control portion 110 (see FIG. 1).

Figure 8:
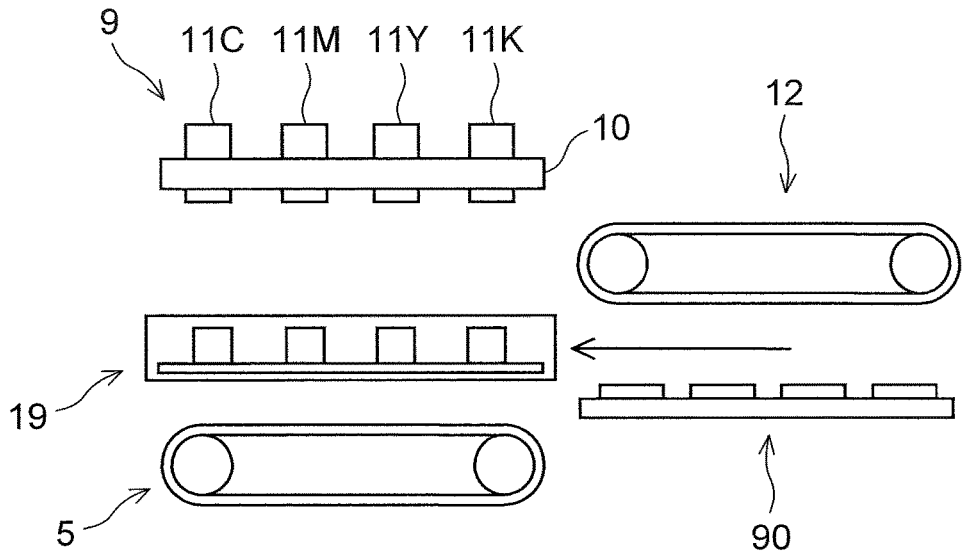
FIG. 8 A diagram showing a state where a maintenance unit is arranged under the recording portion.
Figure 9:
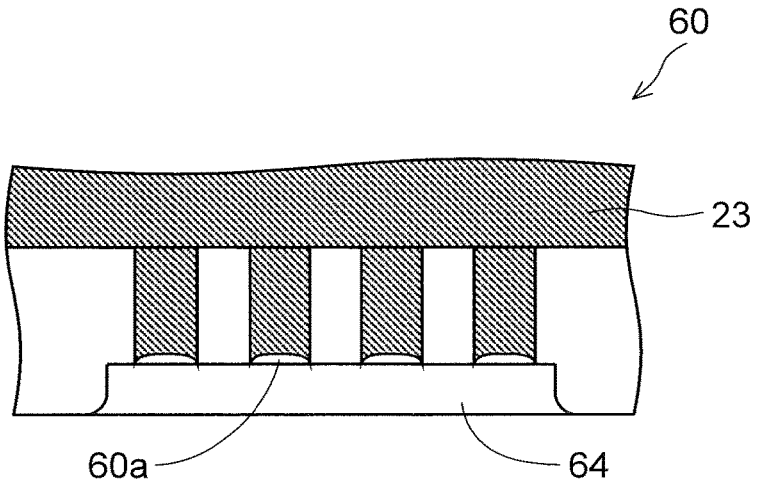
FIG. 9 A diagram showing the structure of the depressed portion and the cleaning liquid supplying openings in the cleaning liquid supplying member on the recording head, illustrating a state where the liquid level of cleaning liquid is formed in the cleaning liquid supplying openings.

When recovery operation for the recording head 17 is performed, as shown in FIG. 8, the control portion 110 (see FIG. 1) lowers the first conveying unit 5 located under the recording portion 9. The control portion 110 then moves the maintenance unit 19 arranged under the second conveying unit 12 horizontally to arrange it between the recording portion 9 and the first conveying unit 5. In this state, the wiper 35 (see FIG. 10) of the maintenance unit 19 is arranged under the ink ejection face F1 and the cleaning liquid supplying face F2 (see FIG. 3) of the recording head 17. Here, the supplying pump 72 is off and, as shown in FIG. 9, the liquid level of the cleaning liquid 23 is in the cleaning liquid supplying openings 60*a*.

Cleaning Liquid Supplying Operation

Figure 10:
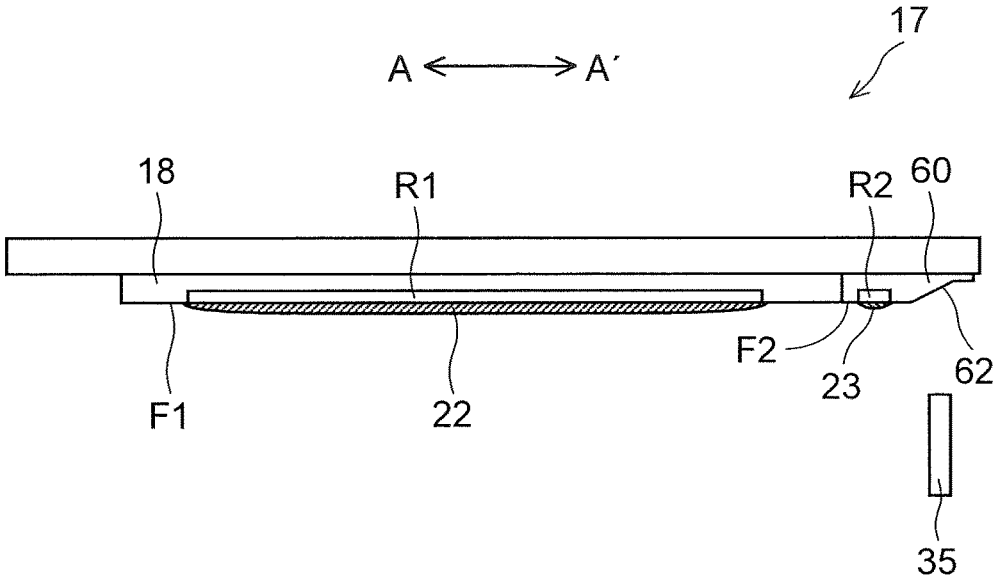
FIG. 10 A diagram showing a state where a wiper is arranged under the recording head.
Figure 11:
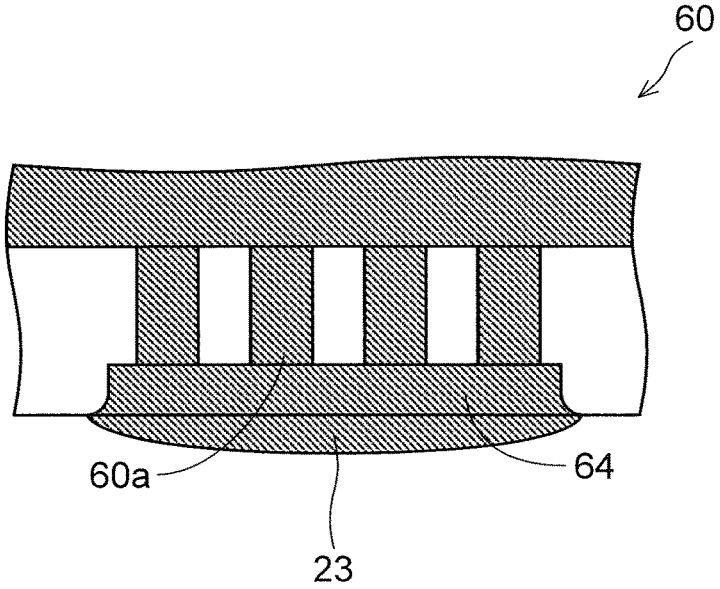
FIG. 11 A diagram showing the structure of the depressed portion and the cleaning liquid supplying openings in the cleaning liquid supplying member on the recording head, illustrating a state where cleaning liquid is supplied from the cleaning liquid supplying openings.

Prior to wiping operation (which will be described later), the control portion 110 (see FIG. 1) drives (turns on) the supplying pump 72 (see FIG. 7), and, as shown in FIG. 10, the cleaning liquid 23 is supplied to the recording head 17. A predetermined time thereafter, the supplying pump 72 is stopped (turned off), and the path between the inflow port and the outflow port of the supplying pump 72 is blocked. Here, in the recording head 17, the cleaning liquid 23 as much as the sum of the volume of cleaning liquid 23 supplied to the cleaning liquid supplying face F2 and the volume of the depressed portion 64 is supplied, and the cleaning liquid 23 is then in a state as shown in FIG. 11. That is, the cleaning liquid 23 projects convexly from the depressed portion 64 under the surface tension of the cleaning liquid 23.

Ink Pushing Out Operation

Prior to wiping operation (which will be described later), the control portion 110 (see FIG. 1) supplies ink 22 to the recording head 17 as shown in FIG. 10. The supplied ink 22 is pushed (purged) forcibly out of the ink ejection openings 18*a*. By this purging operation, thickened ink, foreign matter and air bubbles inside the ink ejection openings 18*a* are discharged from the ink ejection openings 18*a*. Here, the purged ink 22 is pushed out to the ink ejection face F1 along the shape of the ink ejection region R1 in which the ink ejection openings 18*a* lie. In the diagram, the ink (purged ink) 22 is indicated by hatching to facilitate understanding.

Wiping Operation

Figure 12:
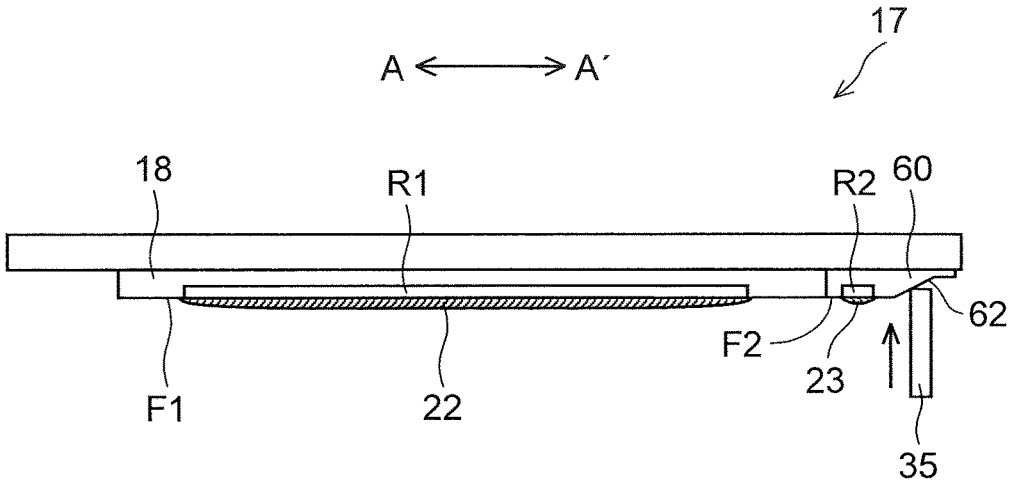
FIG. 12 A diagram showing a state where the wiper is raised from the state in FIG. 10 to be pressed into contact with the cleaning liquid supplying member.

The control portion 110, as shown in FIG. 12, raises the wiper 35 so that the wiper 35 makes contact with an inclined face 62 of the cleaning liquid supplying member 60 of the recording head 17 with a predetermined pressure. Here, the wiper 35 is raised so that the top face of the wiper 35 is approximately 1 mm higher than the ink ejection face F1 and the cleaning liquid supplying face F2. With this, the wiper 35 overlaps with the ink ejection face F1 and the cleaning liquid supplying face F2 by approximately 1 mm. When the wiper 35 has just been raised, it does not need to be in pressed contact with the inclined face 62. That is, the wiper 35 may be raised at a position further to the right in FIG. 12.

Figure 13:
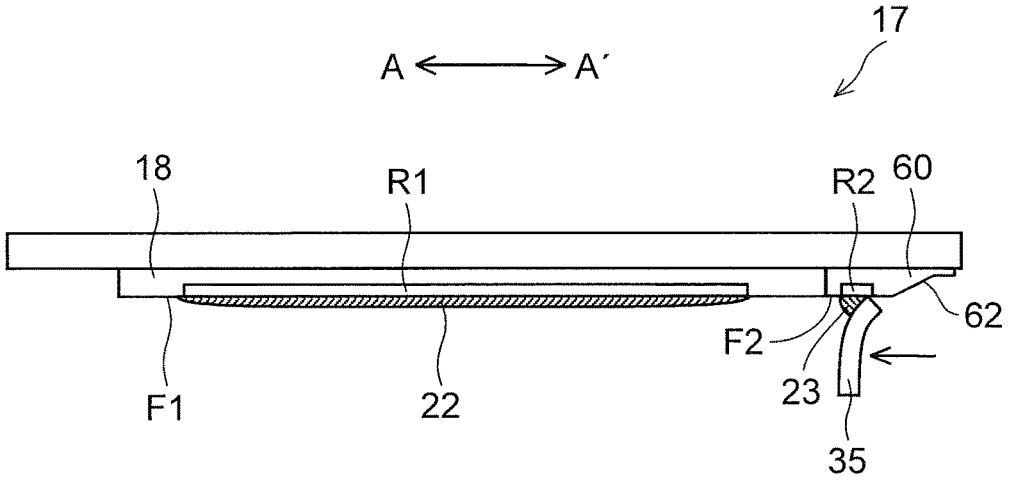
FIG. 13 A diagram showing a state where the wiper in pressed contact with the cleaning liquid supplying member is moved in the arrow A direction from the state in FIG. 12.
Figure 14:
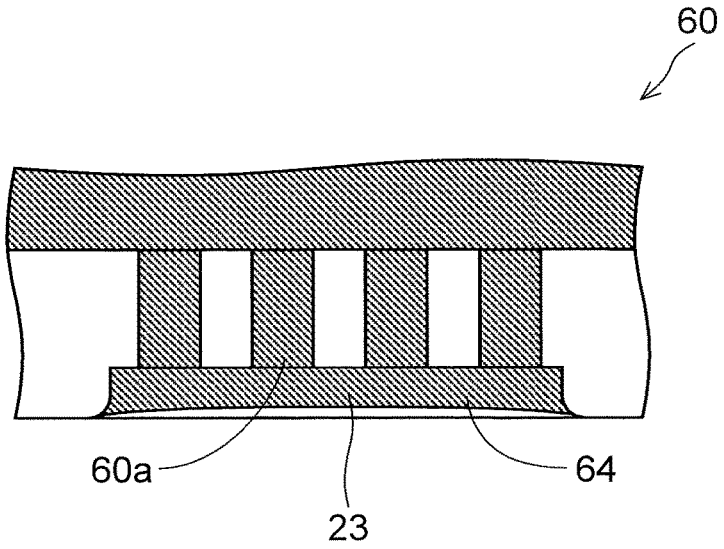
FIG. 14 A diagram showing the structure of the depressed portion and the cleaning liquid supplying openings in the cleaning liquid supplying member on the recording head, illustrating a state where a cleaning liquid supplying face has been wiped by the wiper.

The control portion 110 moves the wiper 35, which is in a state where the tip end of the wiper 35 is in pressed contact with the inclined face 62 of the cleaning liquid supplying member 60, in the direction of the ink ejection region R1 (arrow A direction), as shown in FIG. 13 along the cleaning liquid supplying face F2. With this, the wiper 35 scrapes off the cleaning liquid 23 that protrudes convexly from the depressed portion 64 (here, also a part of the cleaning liquid 23 inside the depressed portion 64 is moved to the wiper 35 side), and thereby the wiper 35 moves toward the ink ejection region R1 while retaining the cleaning liquid 23. Here, the cleaning liquid 23 in the cleaning liquid supplying member 60 is in a state as shown in FIG. 14 and the cleaning liquid 23 pools inside the depressed portion 64. That is, a meniscus of the cleaning liquid 23 is formed inside the depressed portion 64 (around the outer edge of the depressed portion 64). With this, it is possible to prevent the cleaning liquid 23 from flowing out of the depressed portion 64 under the action of external force such as vibration or impact.

When the tip end of the wiper 35 has passed the cleaning liquid supplying region R2, the path between the inflow port and the outflow port of the supplying pump 72 is switched to a communicating state. With this, a negative pressure is applied to the cleaning liquid 23 in the cleaning liquid supplying openings 60*a*, and the cleaning liquid 23 inside the depressed portion 64 is sucked into the cleaning liquid supplying openings 60*a* to return to a state in FIG. 9.

Figure 15:
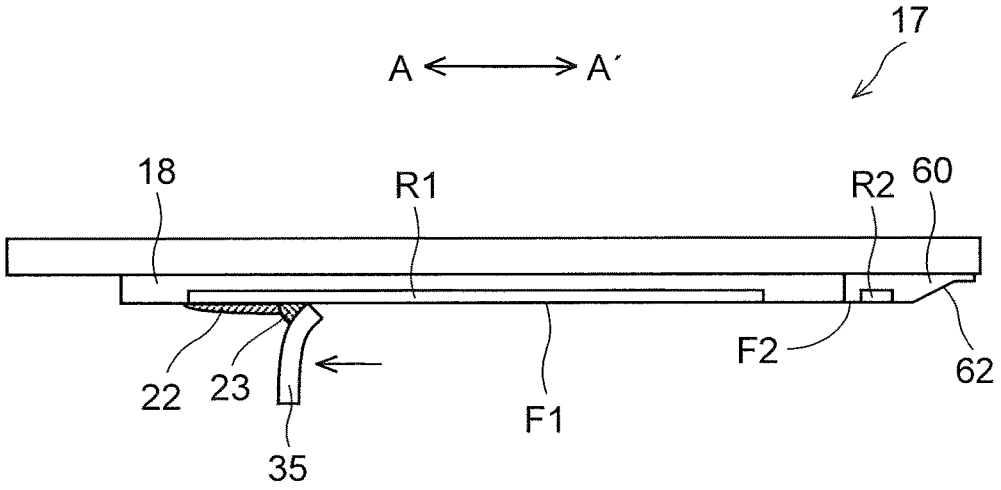
FIG. 15 A diagram showing a state where the wiper has been moved further in the arrow A direction from the state in FIG. 13.

As shown in FIG. 15, the wiper 35, while keeping holding the cleaning liquid 23, moves on the ink ejection face F1 leftward (in the arrow A direction). Here, ink droplets (waste ink) which have attached to the ink ejection face F1 and solidified are dissolved by the cleaning liquid 23 and ink (purged ink) 22 and are wiped off by the wiper 35. When the wiper 35 moves further leftward (in the arrow A direction) to reach a position at the side opposite to the cleaning liquid supplying region R2 relative to the ink ejection region R1, the leftward movement is stopped. The cleaning liquid 23 and the waste ink wiped off by the wiper 35 are collected in a cleaning liquid collection tray (unillustrated) provided in the maintenance unit 19.

Separating Operation

Figure 16:
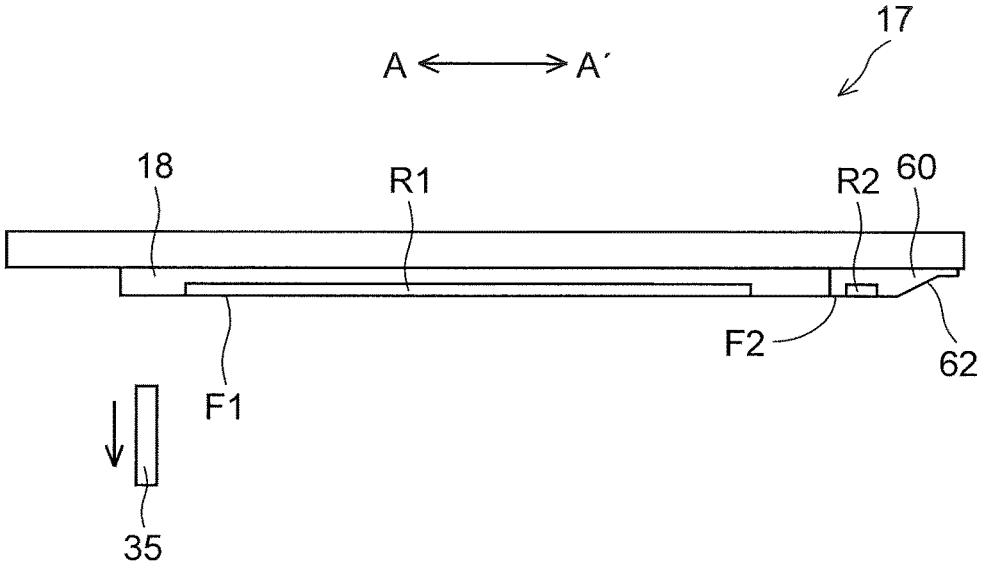
FIG. 16 A diagram showing a state where the wiper has been moved further in the arrow A direction from the state in FIG. 15 and then lowered so that it leaves the ink ejection face.

After wiping operation, as shown in FIG. 16, the control portion 110 lowers the wiper 35 to separate it from the ink ejection face F1.

Finally, the control portion 110 moves the maintenance unit 19 arranged between the recording portion 9 and the first conveying unit 5 horizontally to arrange it under the second conveying unit 12, and raises the first conveying unit 5 up to a predetermined position. Recovery operation for the recording head 17 is thus finished.

As mentioned above, on the upstream side of the ink ejection region R1 in the wiping direction, a plurality of depressed portions 64 are provided. Inside each depressed portion 64, the cleaning liquid supplying openings 60*a* for supplying the cleaning liquid 23 are provided. With this, after supplying the cleaning liquid 23 from the cleaning liquid supplying openings 60*a*, moving the wiper 35 from upstream of the depressed portion 64 in the wiping direction along the ink ejection face F1 permits the wiper 35 to wipe the ink ejection face F1 while holding the cleaning liquid 23. Thus, the ink ejection face F1 can be cleaned.

Inside the depressed portion 64, two or more (here, four) cleaning liquid supplying openings 60*a* are provided along the wiping direction. With this, when recovery operation for the recording head 17 is performed, the number of times the wiper 35 passes the edge (outer edge) of the depressed portion 64 is smaller than the number of times the wiper 35 passes the edge of the cleaning liquid supplying openings 60*a*. That is, the number of times the tip end of the wiper 35 is rubbed against the edge can be reduced. This helps prevent the tip end of the wiper 35 from being damaged.

A plurality of depressed portions 64 are provided in the cleaning liquid supplying region R2 arranged upstream of the ink ejection region R1 in the wiping direction. With this, the path of the ink and the cleaning liquid in the recording head 17 can be formed separately (away from each other), and thus it is possible to prevent the structure of the recording head 17 from becoming complicated.

As mentioned above, the corner portions 64*a* of the outer edge of the depressed portion 64 are rounded as seen in a plan view. This further helps to prevent the tip end of the wiper 35 from being damaged.

Also, as mentioned above, of the outer edge of the depressed portion 64, a part which intersects with the cleaning liquid supplying face F2 is rounded as seen in a cross-sectional view. This further helps to prevent the tip end of the wiper 35 from being damaged.

Also, as mentioned above, the length of the depressed portion 64 in the head width direction is equal to or shorter than 1 mm. This makes it possible, during cleaning liquid supplying operation, to form a meniscus easily around the outer edge of the depressed portion 64.

It is also possible to suppress an increase in the size of the depressed portion 64. That is, it is possible to suppress an increase in the total volume of the depressed portion 64. Thus, it is possible to suppress an increase in the amount of cleaning liquid 23 required to fill the depressed portion 64 with the cleaning liquid 23 as well as an increase in the time for supplying the cleaning liquid 23.

Since an increase in the size of the depressed portion 64 can be suppressed, even if a sheet S is bent, it is possible to prevent the sheet S from entering the depressed portion 64.

The embodiments disclosed above should be understood to be in every aspect illustrative and not restrictive. The scope of the present invention is defined not by the description of the embodiments given above but by the appended claims, and should be understood to encompass any modifications made in the sense and scope equivalent to those of the claims.

For example, while the above embodiments deal with an example where the cleaning liquid supplying member 60 in which the depressed portion 64 and the cleaning liquid supplying openings 60*a* are formed is provided separately from the head portion 18, this is not meant to limit the present invention. Instead of the cleaning liquid supplying member 60 being provided, the depressed portion 64 and the cleaning liquid supplying openings 60*a* may be formed in the head portion 18.

While the above embodiments deal with an example where the outer edge of the depressed portion 64 is formed in a substantially rectangular shape, this is in no way meant to limit the present invention. For example, the outer edge of the depressed portion 64 may be formed in an oval (elliptic) shape or in a circular shape.

Figure 17:
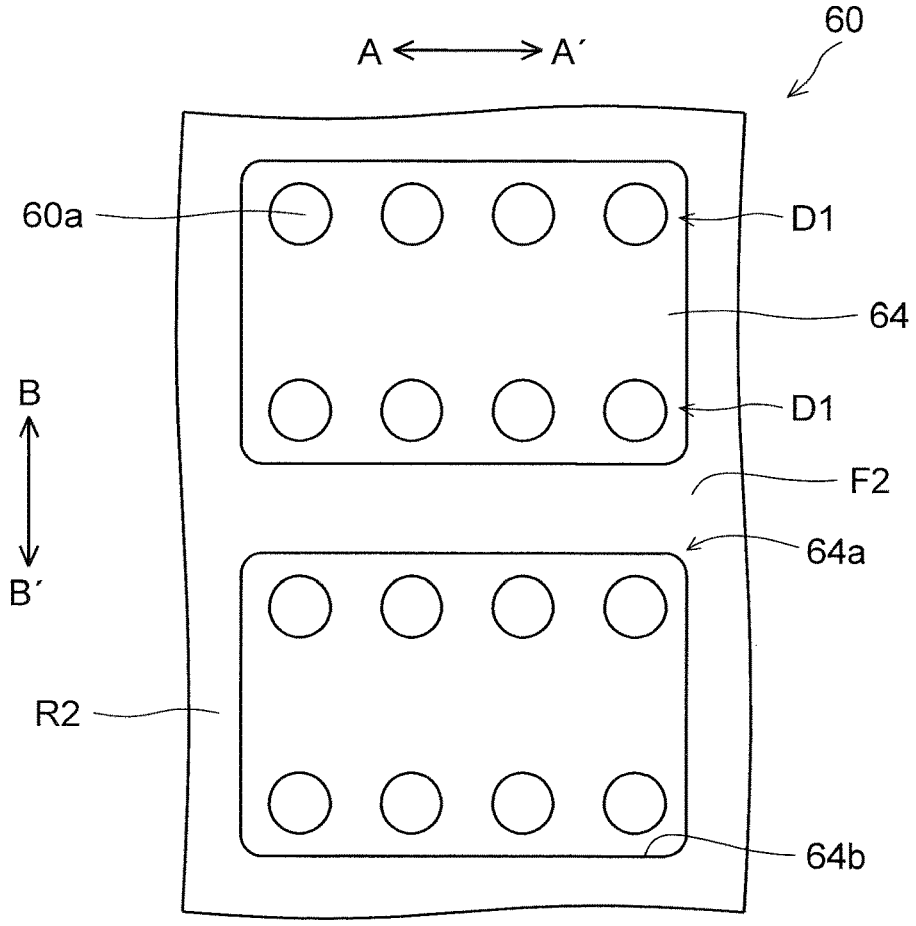
FIG. 17 A diagram showing the depressed portion and the cleaning liquid supplying openings in the cleaning liquid supplying member on the recording head of a modified example of the present invention as seen from below.

While the above embodiments deal with an example provided with four cleaning liquid supplying openings 60*a* arranged inside each depressed portion 64 along the wiping direction, this is not meant to limit the present invention. For example, as in the recording head 17 of the modified example of the present invention shown in FIG. 17, there may be provided, inside each depressed portion 64, a plurality of (here, two) supplying-opening rows D1 arranged in the head width direction, each row comprising two or more (here, four) cleaning liquid supplying openings 60*a* arranged along the wiping direction. With this configuration, the number of parts of the outer edges of the depressed portions 64 that extend in the wiping direction can be reduced, and this further helps to prevent the tip end of the wiper from being damaged.

While the above embodiments deal with an example where recovery operation for the recording head 17 is performed using the cleaning liquid 23 and the ink (purged ink) 22, this is not meant to limit the present invention. Recovery operation for the recording head 17 may be performed using only the cleaning liquid 23. That is, ink purging operation does not necessarily need to be performed.

Any configurations achieved by combining the configurations of the embodiments and modified examples described above are also within the technical scope of the present invention.

The invention claimed is:

1. A recording head comprising an ink ejection face including an ink ejection region in which a plurality of ink ejection openings for ejecting ink onto a recording medium are open, wherein upstream of the entire ink ejection region in a wiping direction which is a direction in which a wiper wipes the ink ejection face, a plurality of depressed portions are provided, and inside each depressed portion, two or more cleaning liquid supplying openings for supplying cleaning liquid are provided along the wiping direction.

2. The recording head according to claim 1, wherein the depressed portion is in a rectangular shape as seen in a plan view, and corner portions of an outer edge of the depressed portion are rounded as seen in a plan view.

3. The recording head according to claim 1, wherein of an outer edge of the depressed portion, a part which intersects with a face wiped by the wiper is rounded as seen in a cross-sectional view.

4. The recording head according to claim 1, wherein inside each depressed portion, there are provided a plurality of supplying-opening rows arranged in a direction perpendicular to the wiping direction, each row comprising two or more cleaning liquid supplying openings arranged along the wiping direction.

5. The recording head according to claim 1, wherein each depressed portion is formed so as to extend along the wiping direction, and the plurality of depressed portions are arranged at a predetermined interval in a direction perpendicular to the wiping direction.

6. The recording head according to claim 1, wherein a length of each depressed portion in a direction perpendicular to the wiping direction is equal to or smaller than 1 mm.

7. An ink-jet recording apparatus comprising a recording head according to claim 1.

* * * * *